United States Patent [19]

Kreeger

[11] Patent Number: 4,577,759

[45] Date of Patent: Mar. 25, 1986

[54] THREE-LEVEL STACKING CONTAINER

[75] Inventor: Elsmer W. Kreeger, Howell, Mich.

[73] Assignee: Pinckney Molded Plastics, Inc., Howell, Mich.

[21] Appl. No.: 692,612

[22] Filed: Jan. 18, 1985

[51] Int. Cl.[4] ..... B65D 21/04

[52] U.S. Cl. ..... 206/505

[58] Field of Search ..... 206/505, 506, 507

[56] References Cited

U.S. PATENT DOCUMENTS

| | | | |
|---|---|---|---|
| 3,398,840 | 8/1968 | Wilson | 206/505 |
| 4,238,032 | 12/1980 | Thurman | 206/507 |
| 4,308,954 | 1/1982 | Wilson | 206/505 |
| 4,320,837 | 3/1982 | Carroll et al. | 206/505 |
| 4,383,611 | 5/1983 | Kreeger | 206/505 |
| 4,520,928 | 6/1985 | Wilson | 206/505 |

FOREIGN PATENT DOCUMENTS

| | | | |
|---|---|---|---|
| 2145063 | 3/1985 | United Kingdom | 206/505 |

*Primary Examiner*—George E. Lowrance

*Attorney, Agent, or Firm*—Basile, Weintraub & Hanlon

[57] ABSTRACT

A three-level stacking container is formed with uniformly spaced openings extending downwardly from the upper edge of each of two opposed sidewalls of the container. The sidewalls take the form of a relatively thin planar web in which the openings are formed and each web is formed with three horizontal, vertically spaced shelves projecting forwardly from the rear edge of each opening. Stacking feet on the outer side of the web may be supported on a selected set of one of the three sets of shelves on an underlying like container, access to the two lower shelves being achieved by passing the feet of the upper container downwardly in the openings forwardly of the shelves. The lowermost of the three shelves constitutes the bottom edge of the opening and the front end of the next uppermost shelf projects forwardly beyond the front end of the uppermost of the three shelves.

3 Claims, 8 Drawing Figures

THREE-LEVEL STACKING CONTAINER

BACKGROUND OF THE INVENTION

The present invention relates to three-level stacking containers of the type employed in the delivery and handling of bakery products. A container of the type to which the present invention is directed is disclosed in my U.S. Pat. No. 4,383,611, and the present invention is specifically directed to improvements to the container of that patent.

The container of my U.S. Pat. No. 4,383,611 is of a type in which the major portion of the front wall of the container is of a reduced height as compared to the side and rear walls, the front wall projecting upwardly above the bottom for a minimum distance sufficient to prevent articles from sliding out the front of the container. This particular arrangement is found convenient in some applications because the type of product carried in the different containers in a stack can be seen readily from the front of the stack.

The container of my U.S. Pat. No. 4,383,611 provides for stacking of one container at any of three selected levels with respect to a like, underlying supporting container. Stacking of a container at the uppermost or high-level position upon the lower container is accomplished by resting stacking feet projecting outwardly from the opposed sidewalls of the upper container upon stacking seats formed along the upper edge of the sidewalls of the underlying container. Downwardly extending openings are provided respectively to the front and to the rear of each stacking seat. The opening at the rear of the stacking seat will guide the stacking foot of a like container to an intermediate level stacking seat underlying the upper stacking seat, while the opening in front of the upper stacking seat will guide a stacking foot to a lower stacking seat underlying both the upper and intermediate stacking seats.

While the container of my U.S. Pat. No. 4,383,611 has received widespread commercial acceptance, movement of an upper container to or from the intermediate stacking level on an underlying container requires the upper container to be moved through a position in which its rear wall is offset rearwardly from the rear wall of the underlying container. Frequently, the container stack is located in a delivery truck with the rear walls of the containers in the stack closely adjacent to or in contact with a wall of the truck or another stack of containers to the point where interference is encountered in stacking and unstacking containers at the intermediate level.

Other examples of containers of this generic type—that is, three-level containers with lowered front walls—are found in U.S. Pat. Nos. 4,320,837 and 4,238,032; however, these latter containers are designed in a fashion such that the stacking feet and upper stacking seat are relatively narrow, in their front-to-rear dimension, thus making the stacking of these latter containers in their high-level position a rather delicate operation which requires a quite precise alignment of the upper and lower containers as the upper container is stacked.

The present invention is directed to an improvement to the construction disclosed in my U.S. Pat. No. 4,383,611 which enables the upper container to be stacked at any of the three levels without requiring the upper container to be moved beyond the rear wall of the underlying container.

SUMMARY OF THE INVENTION

In accordance with the present invention, the two opposed sidewalls of a container are constituted primarily by respective main webs lying in a general plane which is inclined upwardly and slightly outwardly from the container bottom. Two or more openings are formed in each sidewall and extend downwardly from the upper edge of the sidewall web. The stacking seats are defined by three horizontal shelves which project forwardly from the rearward edge of each opening, the lowermost of these three shelves constituting the bottom edge of the opening, while the two other shelves constituting the upper and intermediate shelves are cantilevered outwardly as integral portions of the main web and project forwardly from the rear edge of the opening. The front edge of each opening is spaced forwardly from the forward ends of the shelves by a distance such that a stacking foot of a like container, which projects outwardly from the outer side of the main web near the bottom of the sidewall, can pass downwardly in front of the front ends of the upper and intermediate shelves and then be deflected, by a downwardly and rearwardly inclined section of the front edge, onto the lowermost shelf. The cantilevered upper and intermediate shelves are of relatively narrow extent in their vertical dimension, and these last two shelves are stiffened and reinforced by outwardly projecting ribs which extend the entire length of the sidewall.

Other objects and features of the invention will become apparent by reference to the following specification and to the drawings.

IN THE DRAWINGS

BRIEF DESCRIPTION OF THE PREFERRED EMBODIMENT

Figure 1:
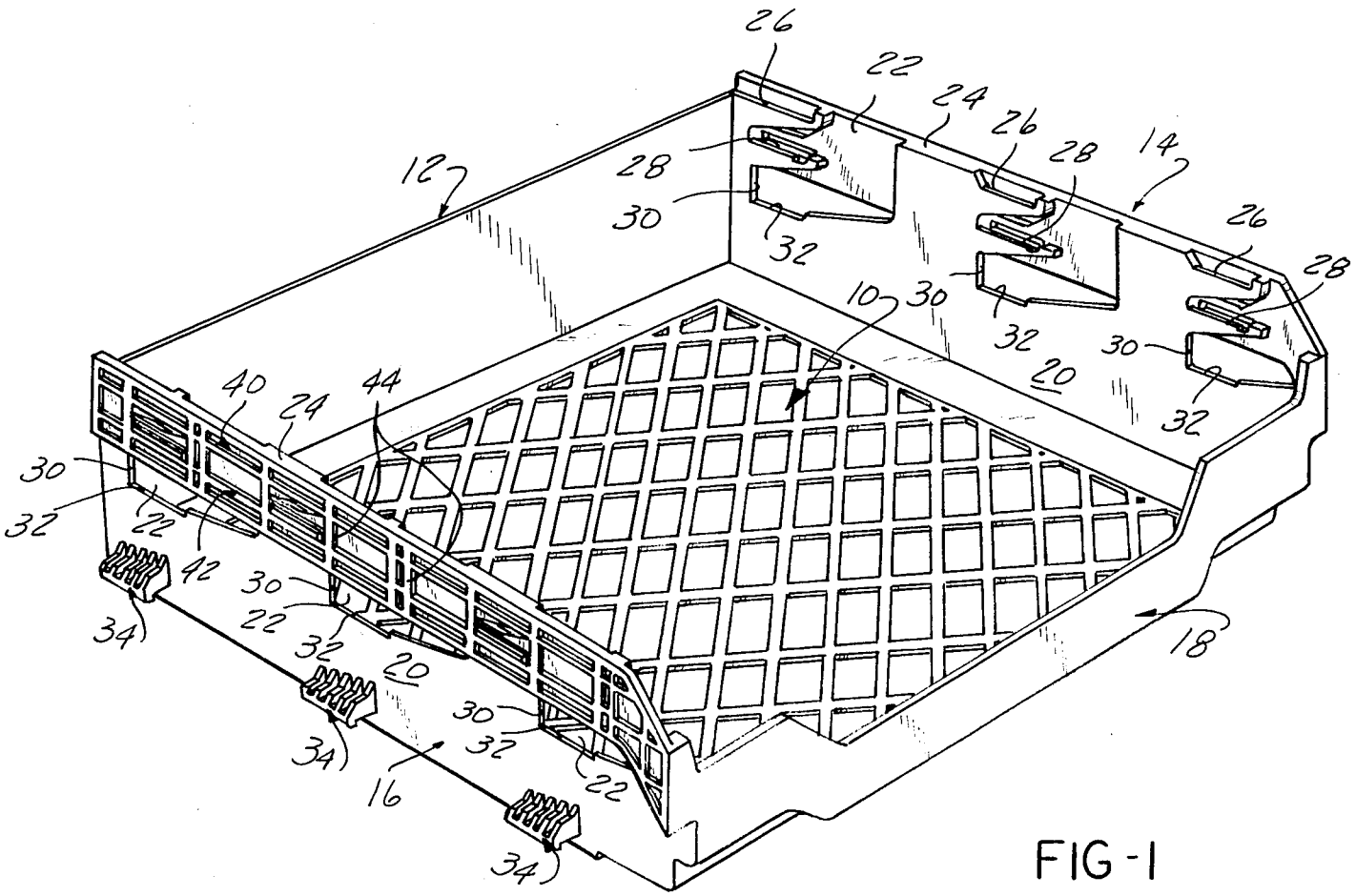
FIG. 1 is a perspective view of a container embodying the present invention.
Figure 2:
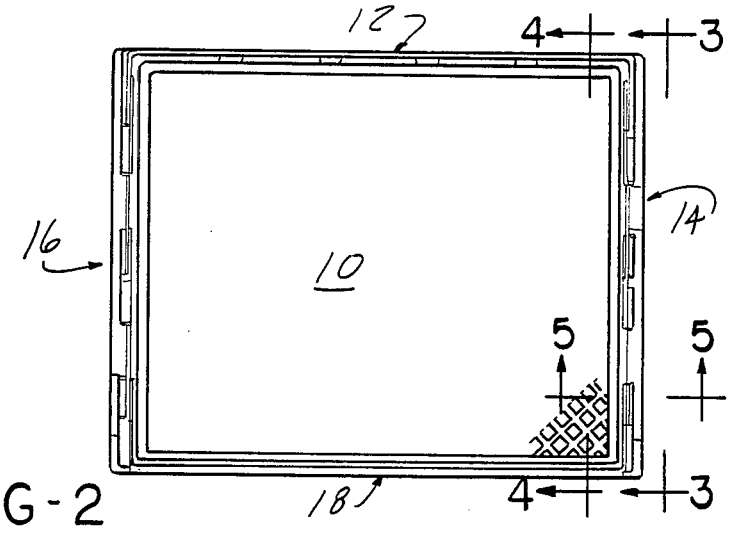
FIG. 2 is a top plan view of the container of FIG. 1.

Referring first to FIG. 1, a three-level container embodying the present invention is formed as a one-piece unit of a molded plastic material, such as polypropylene, to include a generally rectangular container bottom designated generally 10, a rear wall designated generally 12, mirror-image sidewalls 14 and 16 and a relatively low front wall designated generally 18. The various walls 12, 14, 16 and 18 are inclined slightly outwardly in their upward extent from bottom 10.

Figure 3:
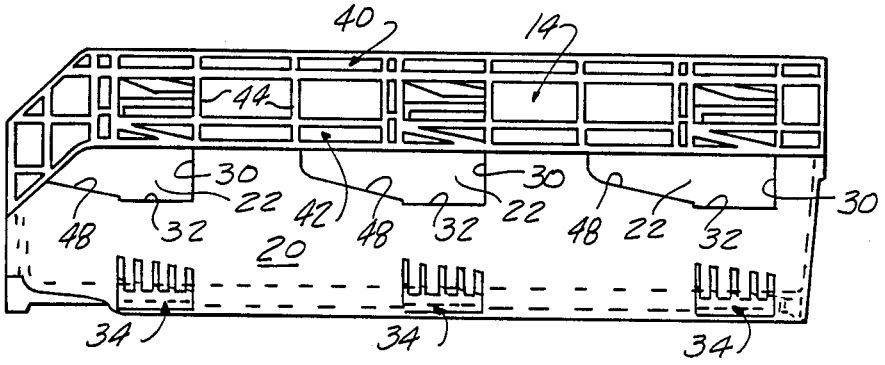
FIG. 3 is a side elevational view of the container of FIG. 1 taken from the plane 3—3 of FIG. 2.
Figure 4:
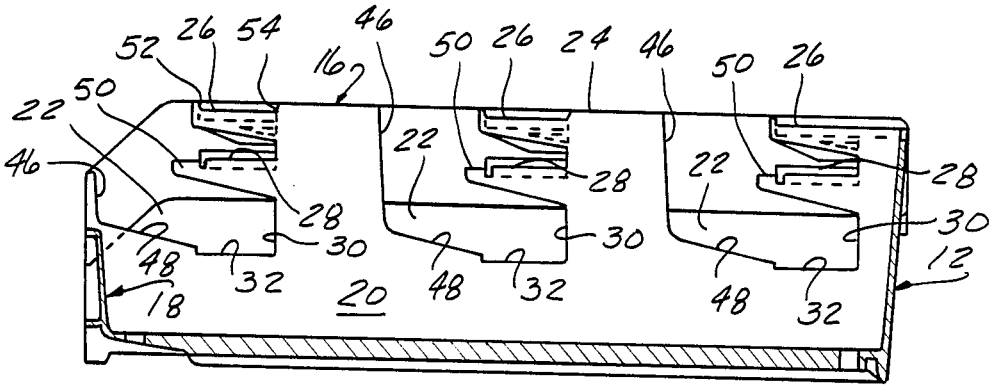
FIG. 4 is a cross-sectional view of the container of FIG. 1 taken on the line 4—4 of FIG. 2.
Figure 5:
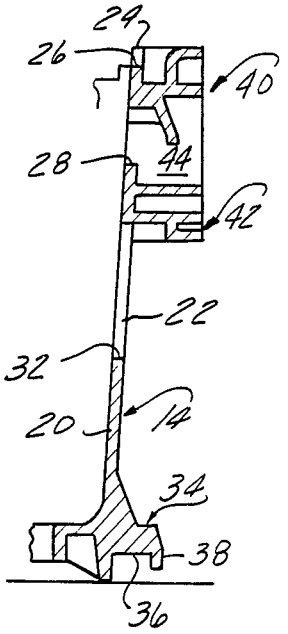
FIG. 5 is a detailed cross-sectional view taken on the line 5—5 of FIG. 2.

Referring now particularly to FIGS. 3, 4 and 5, it is seen that each of sidewalls 14 and 16 is formed with a main web 20 having three openings 22 through the web which extend downwardly from the upper edge 24 of the web. Upper 26 and intermediate 28 stacking shelves project forwardly from the rearward edge 30 of each opening, the shelves 26 and 28 being defined by an integral portion of web 20 which is cantilevered forwardly from the rearward edge 30. A third or lower stacking shelf 32 constitutes the bottom edge of each opening 22. When viewed from the side, as in FIG. 4, the three shelves 26, 28 and 32 are vertically aligned with each other; however, as best seen in FIG. 5, the slight outward inclination of main web 20 finds the shelves laterally offset slightly from precise vertical alignment with each other.

A corresponding number of stacking feet designated generally 34 are integrally formed on the lower outer side of web 20, each stacking foot being located in alignment vertically with the stacking shelves 32, 28, 26 of an associated opening 22. As best seen in the cross-sectional view of FIG. 5, each stacking foot is provided with a horizontal stacking surface 36 which laterally overlaps vertically the three associated stacking shelves. A downwardly projecting lip 38 at the outer end of surface 36 hooks over, as will be described below, the various stacking shelves to limit lateral displacement of one stacked container relative to its supporting container.

As best appreciated from the cross-sectional view of FIG. 5, main web 20 is not very thick. In order to strengthen and stiffen the relatively narrow cantilevered shelves 26 and 28, upper and lower stiffening ribs designated generally 40 and 42 are integrally formed on the outer side of web 20 at each of shelves 26 and 28 and, as best seen in FIGS. 1 and 3, the ribs 40 and 42 extend continuously for the entire length of the sidewalls and are in turn coupled to each other by a series of vertically extending webs or ribs such as 44. The underside of ribs 42 further provides a downwardly facing shoulder which is of convenience in manually lifting or carrying the container.

Referring now particularly to FIG. 4, it is seen that each opening 22 includes a generally vertical front edge 46 which extends downwardly from the upper edge 24 of web 20. The front edges 46 of the various openings are spaced forwardly from the front ends of upper shelf 26 and intermediate shelf 28 by a distance which is somewhat greater than the front-to-rear dimensions of the various stacking feet 34 so that the feet on one container may be engaged with the front edges 46 of the openings of a like underlying container and lowered downwardly into opening 22 past the upper and intermediate shelves 26 and 28 until they strike a downwardly and rearwardly inclined edge 48 at the lower end of front edge 46 along which the feet can be guided to lower shelf 32.

To assist in engaging the stacking feet of one container with the intermediate seats 28 of a like container, the forward ends 50 of intermediate stacking seats 28 are projected slightly forwardly beyond the front end of the overlying upper seat 26.

Figure 6:
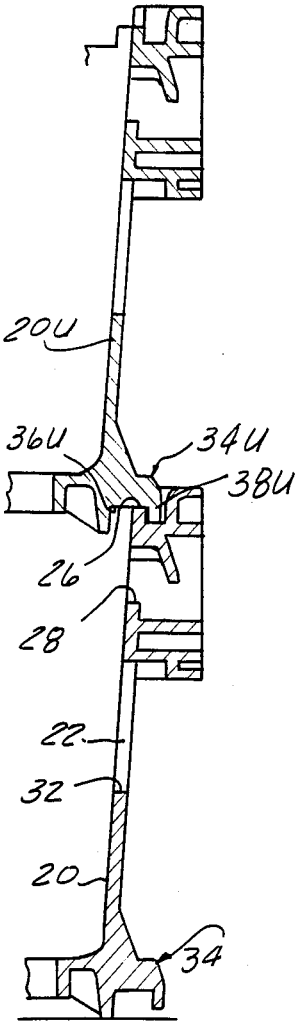
FIG. 6 is a detailed cross-sectional view, similar to FIG. 5, showing two like containers stacked in the high-level position.
Figure 7:
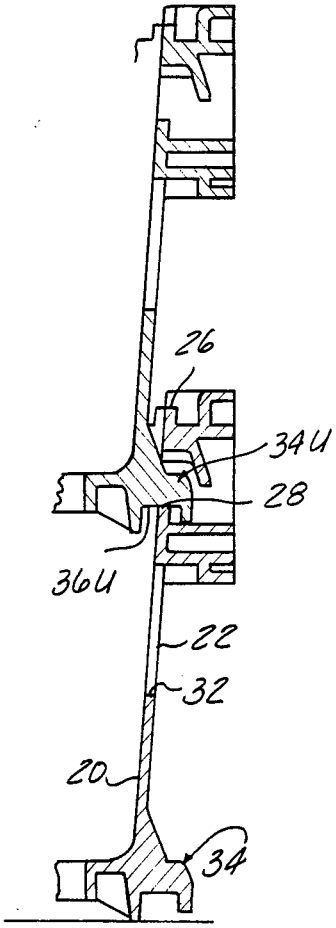
FIG. 7 is a cross-sectional view, similar to FIG. 6, showing two containers stacked at the intermediate level.
Figure 8:
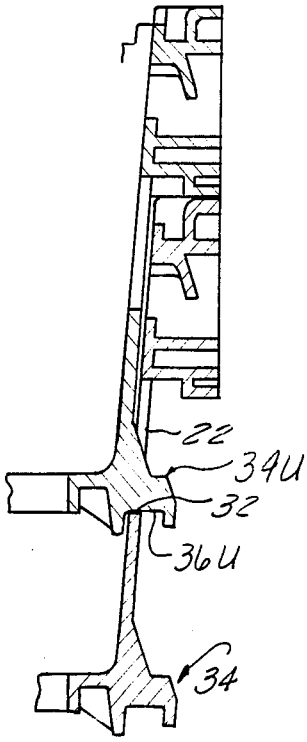
FIG. 8 is a cross-sectional view, similar to FIG. 6, showing the two containers stacked in the low-level position.

The stacking of two containers of the present invention in upper, intermediate and lower stacking positions is indicated in FIGS. 6, 7 and 8. FIGS. 6, 7 and 8 are cross-sectional views similar to FIG. 5; parts of the upper container are identified with reference numerals carrying a subscript "U" in these figures.

Two containers embodying the present invention stacked in an upper- or high-level relationship are shown in FIG. 6. The horizontal support surface 36U of a stacking foot 34U of the uppermost of the two containers in FIG. 6 is shown resting upon the stacking seat 26 of the underlying container. Forward or rearward movement of the upper container relative to the underlying container when in the high-stacked position of FIG. 6 is restricted by shoulders 52, 54 (FIG. 4) which engage opposite ends of the stacking foot seated on the seat 26.

In FIG. 7, the two like containers are shown at the intermediate stacked position in which the support surface 36U of the stacking foot 34U of the upper container is supported upon stacking seat 28 of the underlying container. As described above, the stacking feet are located on the intermediate seat 28 of the lower container by passing the stacking feet of the upper container downwardly past the front end of the upper stacking seats 26 of the underlying container until the stacking feet 34U of the upper container engage the forwardly projecting end portions 50 of the intermediate stacking seat 28. The upper container is then lifted slightly and slid rearwardly until the stacking foot abuts the rear edge 30 of the respective openings.

FIG. 8 shows the two containers in the nested or lower stacked position relative to each other, with the support surface 36U of the stacking foot 34U of the upper container now resting on the lower stacking shelf 32. The stacking feet of the upper container are moved to this position by sliding the forward edge of the stacking feet of the upper container downwardly along the front edges 46 of the openings in the lower container and thence downwardly and rearwardly along the inclined surface 48 of the opening to the lower stacking shelf 32.

While one embodiment of the invention has been described in detail, it will be apparent to those skilled in the art that the embodiment described may be modified. Therefore, the foregoing description is to be considered exemplary rather than limiting, and the true scope of the invention is that defined in the following claims.

I claim:

1. In a multilevel stacking container having a rectangular bottom, a pair of upwardly projecting sidewalls and a rear wall projecting upwardly respectively from opposed side edges and the rear edge of said bottom to a substantially uniform height, and a front wall projecting upwardly from the front edge of said bottom to a height less than said uniform height;

the improvement wherein each of said sidewalls comprises a main web lying in a general plane inclined upwardly and outwardly from said bottom, said web having a plurality of like openings therethrough extending downwardly from the upper edge of said web at spaced locations along said web, each of said openings having a front edge and a rear edge, means on said web defining first, second and third horizontal shelves extending forwardly from the rear edge of the opening in vertically spaced, substantially vertical alignment with each other, said third shelf constituting the bottom edge of the opening, a plurality of like stacking feet projecting outwardly from the outer side of said web adjacent said bottom in respective vertical alignment with the shelves of said openings, the front edge of each opening being spaced forwardly from the front ends of the shelves by a distance greater than the front-to-rear dimensions of the aligned stacking foot, each of said shelves being adapted to receive and support a stacking foot of a like container, and continuous reinforcing rib means integral with said first and second shelves and projecting outwardly from the outer side of said main web, said rib means extending the entire length of said sidewall and passing across said openings outwardly of said main web.

2. The invention defined in claim 1 wherein the second shelves underlie their associated first shelves and the front end of each second shelf projects forwardly beyond the front end of the overlying first shelf.

3. The invention defined in claim 2 wherein each opening is formed with an inclined guide edge extending upwardly and forwardly from the front end of the third shelf to merge with the front edge of the opening at a location below the level of the bottom of the second shelf.

* * * * *